US010766253B2

(12) United States Patent
West et al.

(10) Patent No.: US 10,766,253 B2
(45) Date of Patent: Sep. 8, 2020

(54) SIDEBAND SIGNAL FOR FLUID EJECTION

(71) Applicant: Hewlett-Packard Development Company, L.P., Spring, TX (US)

(72) Inventors: Matthew James West, Corvallis, OR (US); Jose Miguel Rodriguez, San Diego, CA (US); Matthew J. Gelhaus, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/339,821

(22) PCT Filed: Oct. 7, 2016

(86) PCT No.: PCT/US2016/056062
§ 371 (c)(1),
(2) Date: Apr. 5, 2019

(87) PCT Pub. No.: WO2018/067176
PCT Pub. Date: Apr. 12, 2018

(65) Prior Publication Data

US 2020/0047495 A1 Feb. 13, 2020

(51) Int. Cl.

| | |
|---|---|
| ***B41J 2/045*** | (2006.01) |
| ***B41J 2/125*** | (2006.01) |
| ***B41J 2/21*** | (2006.01) |

(52) U.S. Cl.
CPC ..... *B41J 2/04573* (2013.01); *B41J 2/04505* (2013.01); *B41J 2/125* (2013.01); *B41J 2/2146* (2013.01)

(58) Field of Classification Search
CPC .. B41J 2/04573; B41J 2/04545; B41J 2/2146; B41J 2/125
See application file for complete search history.

(56) References Cited

U.S. PATENT DOCUMENTS

| | | | |
|---|---|---|---|
| 5,719,602 | A | 2/1998 | Hackleman |
| 8,488,199 | B2 | 7/2013 | Kawamoto |
| 8,953,179 | B2 | 2/2015 | Sawano |
| 2004/0179717 | A1 | 9/2004 | Furukawa |
| 2005/0146547 | A1 | 7/2005 | Yeh |
| 2006/0115127 | A1 | 6/2006 | Hatayama |

(Continued)

OTHER PUBLICATIONS

Colorstream3500, Dec. 2011, <http://ss1.spletnik.si/4_4/000/000/441/d8d/ColorStream3500_Demo_Guide.pdf>.

*Primary Examiner* — Sharon A. Polk
(74) *Attorney, Agent, or Firm* — Tong Rea Bentley & Kim LLC

(57) ABSTRACT

In example implementations, a fluid ejection system is provided. The fluid ejection system includes a plurality of fluid ejection devices, a sensor and a feedback system. The plurality of fluid ejection devices can distribute fluid onto a media. The sensor may analyze a line of an image formed by the fluid on the media. The feedback system can determine a respective amount of time delay for each one of the plurality of fluid ejection devices based on the line of the image on the media that is analyzed by the sensor. The respective amount of time delay is inserted into at least one sideband signal to provide a correct alignment of the fluid ejection devices when printing a subsequent line of the image on the media.

15 Claims, 5 Drawing Sheets

(56) References Cited

U.S. PATENT DOCUMENTS

| | | | | |
|---|---|---|---|---|
| 2010/0091334 | A1* | 4/2010 | Qiao | G03G 15/5062 358/3.26 |
| 2013/0286128 | A1 | 10/2013 | Ishimori | |
| 2013/0301083 | A1 | 11/2013 | Kaneda | |
| 2015/0116734 | A1 | 4/2015 | Howard | |
| 2015/0116736 | A1 | 4/2015 | Howard | |

* cited by examiner

SIDEBAND SIGNAL FOR FLUID EJECTION

BACKGROUND

Print systems are used to print on various types of media or substrates. Some media and substrates have large widths. Print systems can include fluid ejection devices that span a width of the media that can print across the large widths of some media. The fluid ejection devices can eject fluid onto the media or substrate to print an image.

DETAILED DESCRIPTION

The present disclosure discloses methods and apparatuses for distributing a plurality of real-time sideband signals in a distributed print system. Many print systems utilize sideband signals. Sideband signals are signals other than the image data to be printed that are used to control and synchronize the printing of the image data. These sideband signals may include speed or position of the media relative to the fluid ejection devices, or timing information for an event such as top-of-form.

As discussed above, some print systems may be capable of printing across a large width of a media. For example, some print systems may print across a media that is 110 inches wide. The sideband signals may be used to synchronize the printing of the image data across these large widths that use a plurality of fluid ejection devices.

To handle such large widths, multiple sub systems can be wired together to work together to print across the large widths of media. The sub systems can be wired together to allow each sub system to receive the sideband signals for accurate printing.

However, some wiring methods can have signal integrity challenges and physical cable routing issues. These wiring methods do not scale well when additional sub systems are added as the distributed print system is used to print on wider and wider media.

The present disclosure uses concepts of time division multiplexing within the distributed print system to ensure that the real-time sideband signals are properly delayed for each sub system. As a result, each sub system may receive the real-time sideband signal at the correct time to accurately eject fluid onto a media.

In addition, the present disclosure provides a method that is easily scalable as additional sub systems are added to the distributed print system. Using the methods of the present disclosure, adding large amounts of additional physical wiring and hardware when sub systems are added may be avoided.

Figure 1:
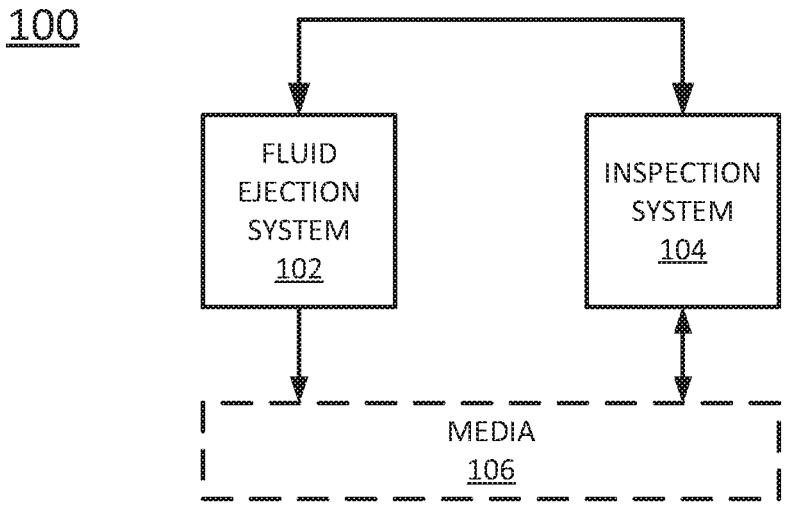
FIG. 1 is a block diagram of an example system of the present disclosure.

FIG. 1 illustrates a block diagram of an example system 100 of the present disclosure. In one example, the system 100 may include a fluid ejection system 102 and an inspection system 104. The fluid ejection system 102 may dispense fluid or ink to thereby deposit fluid onto a media 106 such that an image may be formed on the media 106. The media 106 may be paper, plastic or any other substrate that may receive the fluid or ink from the fluid ejection system 102. As will be appreciated, the fluid ejection system 102, as described herein, may selectively eject droplets of fluid such that the droplets of fluid may be deposited on the media 106. The patterning of such deposited droplets of fluid on the media 106 may cause an image to be formed on the media 106. Such formation of an image may be referred to as printing. In other examples, the patterning of such deposited droplets of fluid on the media 106 may be performed in a layer-wise additive manufacturing process, where the formation of the image may correspond to formation of a cross-sectional portion of a three-dimensional object.

In one implementation, the inspection system 104 may be used to analyze the image that is printed onto the media 106. The results of the analysis may be fed back to the fluid ejection system 102 to allow one or more adjustments to be made by the fluid ejection system 102 when printing subsequent lines of the image onto the media 106.

Figure 2:
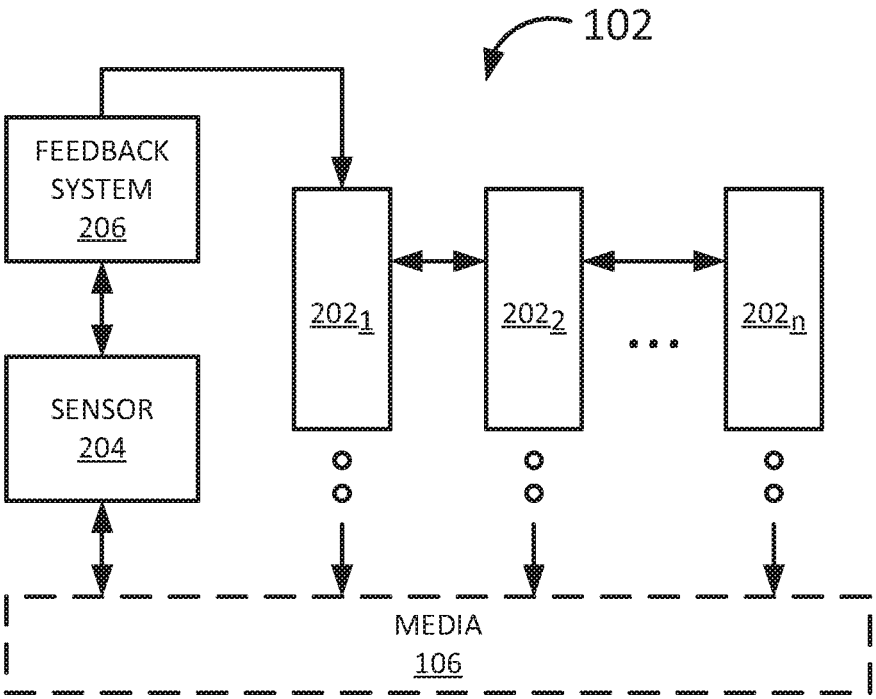
FIG. 2 is a block diagram of an example fluid ejection system of the present disclosure.

FIG. 2 illustrates a block diagram of one example of the fluid ejection system 102. In one implementation, the fluid ejection system 102 may include a plurality of fluid ejection devices $\mathbf{202}_1$ to $\mathbf{202}_n$ (hereinafter referred to individually as fluid ejection device 202 or collectively as fluid ejection devices 202). In one example, the fluid ejection devices 202 may be controlled to print each line of an image onto the media 106.

In some implementations, the fluid ejection devices 202 may be controlled by real-time sideband signals that instruct each one of the fluid ejection devices 202 when to print. The real-time sideband signals may be generated by a controller or a processor (not shown) of the fluid ejection system 102 based on a print job that is received.

In some examples, the media 106 may be wide. For example, the media 106 may be up to 110 inches wide or even greater that uses more than one fluid ejection device 202 to print each line. If the real-time sideband signals are not received with a correct timing by the fluid ejection devices 202, each line of the image may be printed incorrectly. In other words, if some of the fluid ejection devices 202 receive the real-time sideband signals at incorrect times, then there may be a visible offset between pixels printed by different fluid ejection devices 202.

In some examples, the multiple sub systems use the sideband signals that arrive at each sub system at the exact same time. This may be the case when different sub systems control fluid ejection devices 202 that are arranged next to each other across the width of the media 106. The sub systems receive the sideband signals at the same time to ensure that the pixels are printed at the same down-web locations (e.g., a direction of the media transport) on the media 106.

In other examples, the multiple sub systems may receive the sideband signals at different, but related times. This may be the case when the different sub systems control the fluid ejection devices 202 that are arranged upstream and downstream from each other along a length of the media 106. The sub system may receive the sideband signals, with the appropriate delays to ensure that the pixels are printed at the same down-web locations on the media 106.

In one example, the fluid ejection system 102 may include a sensor 204 and feedback system 206. The sensor 204 and the feedback system 206 may be part of the inspections system 104 that is part of the fluid ejection system 102 or a component that is separate from the fluid ejection system 102.

In one example, the sensor 204 may be an optical sensor that analyzes each line that is printed by the fluid ejection devices 202. The sensor 204 may analyze each line to detect or collect information regarding a location of each pixel that is printed by two different fluid ejection devices 202. The feedback system 206 may determine how much offset exists between two different pixels based on the location information collected by the sensor 204.

The feedback system 206 may use the amount of offset to calculate an amount of time delay for each fluid ejection device 202 to receive the real-time sideband signals. For example, using the amount offset that is determined by the sensor 204 and knowing the speed at which the media 106 is moving, or the speed at which the plurality of fluid dejection devices 202 are moving, the feedback system 206 can calculate the amount of time delay for each fluid ejection device 202.

The amount of time delay may be defined as a difference in the amount of time that each fluid ejection device 202 takes to receive a respective real-time sideband signal relative to a reference fluid ejection device 202. For example, the reference fluid ejection device 202 may be the fluid ejection device 202 that receives the real-time sideband signal first.

The respective amount of time delay calculated for each one of the fluid ejection devices 202 may be inserted into the real-time sideband signals. As a result, each one of the fluid ejection devices 202 may receive the real-time sideband signals at the correct time to ensure that the pixels printed by the fluid ejection devices 202 are aligned properly such that each line of the image is printed accurately. In other words, the amount of time delay may allow each one of the fluid ejection devices 202 to receive the real-time sideband signal at a correct time that correctly aligns the fluid ejection devices 202 when printing. Said another way, the amount of time delay that is inserted into the real-time sideband signals may synchronize the fluid ejection devices 202. For example, a first fluid ejection device 202 may be at a different location than a second fluid ejection device 202 along the width of the media 106. The amount of time delay that is inserted into the real-time sideband signal may synchronize the first fluid ejection device 202 and the second fluid ejection device 202 such that fluid that is dispensed by the first fluid ejection device 202 and the second fluid ejection device 202 may hit the same location on the media 106. Notably, if the real-time sideband signal is not received at a correct time by the second fluid ejection device 202, then the fluid dispensed by the second fluid ejection device 202 may not be at the same location as the fluid dispensed by the first fluid ejection device 202 causing an offset or a misalignment of the pixels during printing.

In contrast, some systems use a complicated system of physical cabling to ensure that each fluid ejection device 202 receives the real-time sideband signals. For example, each fluid ejection device 202 is physically connected to a source of the real-time sideband signals using wide parallel cables. However, the number of physical connections for each fluid ejection system 102 may be limited and as printing widths grow and additional fluid ejection devices 202 are added, physical cabling may grow more complicated and consume more space in the fluid ejection system 102. In addition, physical cabling may suffer from skew, signal loss and degradation over time.

With the fluid ejection system 102 of the present disclosure, a single optical connection may be used for each fluid ejection device 202. In addition, any signal loss or degradation can be compensated for based on the amount of time delay that is calculated by the inspection system 104 or the feedback system 206.

Figure 3:
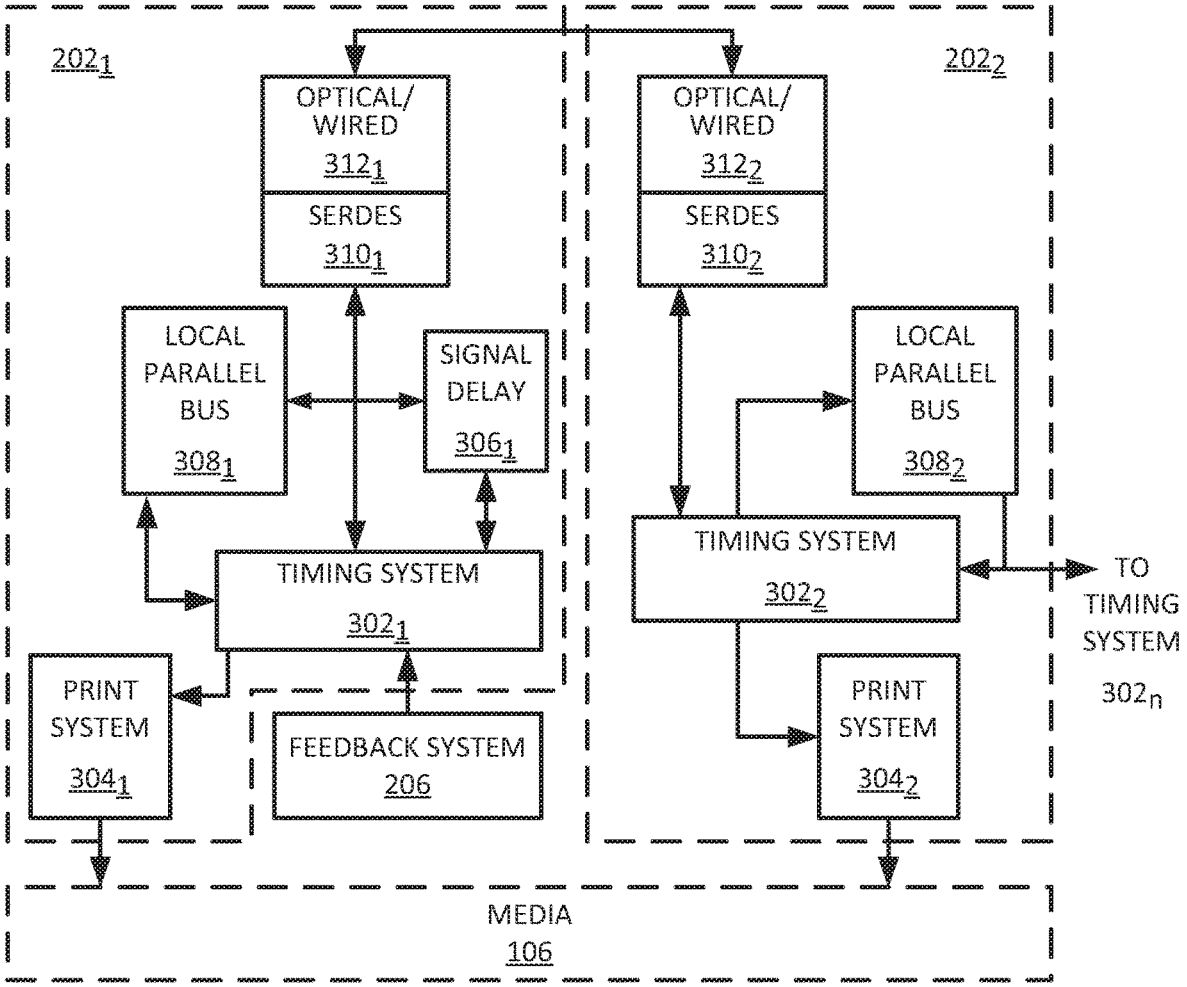
FIG. 3 is a block diagram of example fluid ejection devices of the present disclosure.

FIG. 3 illustrates one example of the fluid ejection devices 202 and how the fluid ejection devices are connected. In one example, a first fluid ejection device $\mathbf{202}_1$ may include a timing system $\mathbf{302}_1$, a print system $\mathbf{304}_1$, a signal delay $\mathbf{306}_1$, a local parallel bus $\mathbf{308}_1$, a serializer/deserializer (SERDES) $\mathbf{310}_1$ and an optical/wired connection $\mathbf{312}_1$. In one example, a second fluid ejection device $\mathbf{202}_2$ may include a timing system $\mathbf{302}_2$, a print system $\mathbf{304}_2$, a local parallel bus $\mathbf{308}_2$, a SERDES $\mathbf{310}_2$ and an optical/wired connection $\mathbf{312}_2$. Although two fluid ejection devices $\mathbf{202}_1$ and $\mathbf{202}_2$ are illustrated in FIG. 3, it should be noted that any number of fluid ejection devices may be deployed.

In one implementation, the timing system $\mathbf{302}_1$ may receive the amount of time delay for each fluid ejection device 202 (e.g., fluid ejection device $\mathbf{202}_2$ in the present example) that is calculated by the feedback system 206. The timing system $\mathbf{302}_1$ may perform the insertion and transmission of the amount of time delay into the real-time sideband signals that are transmitted to the other fluid ejection devices 202.

In one example, the amount of time delay may be inserted using a delay module. In one example, the delay module may be a programmable delay module such as the signal delay module $\mathbf{306}_1$. In another example, the delay module may be a non-programmable delay module such as the local parallel bus $\mathbf{308}_1$.

The timing system $\mathbf{302}_1$ may insert the amount of time delay into the real-time sideband signal via one or more of the delay modules and then transmit the real-time sideband signals with the amount of time delay inserted. For example, the print system $\mathbf{304}_1$ may receive one of the real-time sideband signals with the respective amount of time delay to eject the fluid or ink onto the media 106. The inserted amount of time delay may allow the fluid ejection device $\mathbf{202}_1$ to operate based on the real-time sideband signal at the same time that the fluid ejection device $\mathbf{202}_2$ operates based on the real-time based sideband signal.

The timing system $\mathbf{302}_1$ may also transmit the other real-time sideband signals through the SERDES $\mathbf{310}_1$ and the optical/wired connection $\mathbf{312}_1$. The SERDES $\mathbf{310}_1$ may serialize a plurality of real-time sideband signals into a serial signal that can be transmitted to other fluid ejection devices via the optical/wired connection $\mathbf{312}_1$. For example, if there were two additional fluid ejection devices 202, then the SERDES $\mathbf{310}_1$ may serialize the two real-time sideband signals addressed to the two additional fluid ejection devices 202. The optical/wired connection $\mathbf{312}_1$ allows the real-time sideband signals to be transmitted faster than using other types of physical cabling.

The real-time sideband signal with the amount of time delay inserted may be received by the optical/wired connection $\mathbf{312}_2$ and deserialized (if necessary) by the SERDES $\mathbf{310}_2$. The timing system $\mathbf{302}_2$ may receive the respective real-time sideband signal with the amount time delay and transmit the real-time sideband signal to the print system $\mathbf{304}_2$ of the fluid ejection device $\mathbf{202}_2$. As a result, the print system $\mathbf{304}_1$ and the print system $\mathbf{304}_2$ may receive the real-time sideband signals at the correct time to print on the media 106 with a correct alignment. For example, if there is a respective amount of time delay associated with the fluid ejection device $\mathbf{202}_2$, then the print system $\mathbf{304}_2$ may receive the real-time sideband signal with the respective amount of time delay that is inserted.

Figure 4:
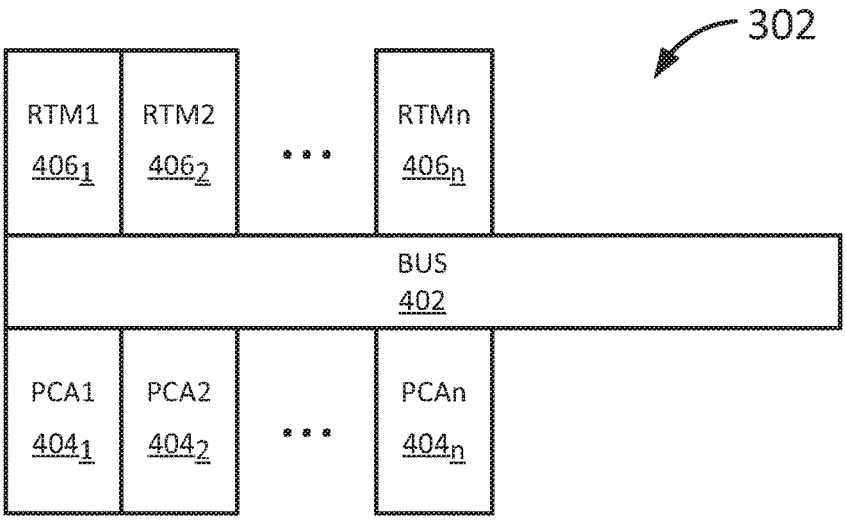
FIG. 4 is a block diagram of an example timing system of the present disclosure.

FIG. 4 illustrates an example block diagram of the timing system 302. In one implementation, the timing system 302 may include a bus 402, a plurality of computation printer circuit assemblies (PCA) $\mathbf{404}_1$-$\mathbf{404}_n$ (hereinafter referred to individually as computation PCA 404 or collectively as computation PCAs 404) and a plurality of rear transition modules (RTMs) $\mathbf{406}_1$-$\mathbf{406}_n$ (hereinafter referred to individually as RTM 406 or collectively as RTMs 406).

In one example, each computation PCA 404 may be responsible for calculating the print parameters and generating a sideband signal to print on a predetermined width of an image associated with a respective computation PCA 404. For example, each computation PCA 404 may be responsible for printing on a different predetermined width of the media 106. Thus, if a width of the media 106 is wider than a total width capability of the number of computation PCAs 404 within a fluid ejection device 202, then additional fluid ejection devices 202 may be added to add additional computation PCAs 404. The real-time sideband signals for each portion of the image may be generated by the computation PCAs $\mathbf{404}_1$ to $\mathbf{404}_n$. The real-time sideband signals may then be transmitted by the respective RTMs $\mathbf{406}_1$ to $\mathbf{406}_n$.

In one example, each computation PCA 404 may also be responsible for calculating the print parameters and generating a sideband signal to print in a down-web direction as well. For example, each computation PCA 404 may control a different printbar or color, which print at the same part of the width, but one is upstream relative to the other.

As noted above, previously, the RTMs 406 were all connected by a daisy chain of physical wires and cabling. As additional PCAs 404 are deployed with additional fluid ejection devices 202, large parallel buses were added to daisy chain all of the RTMs 406. However, with the design of the fluid ejection system 102 of the present disclosure, a single optical connection can be used to connect all of the RTMs 406 using a SERDES 310.

In addition, the delay associated with serializing the signals can be compensated for by calculating a respective amount of time delay for each fluid ejection device 202 to receive the real-time sideband signal. The respective amount of time delay can be inserted into the real-time sideband signal that is transmitted to the fluid ejection devices 202.

Figure 5:
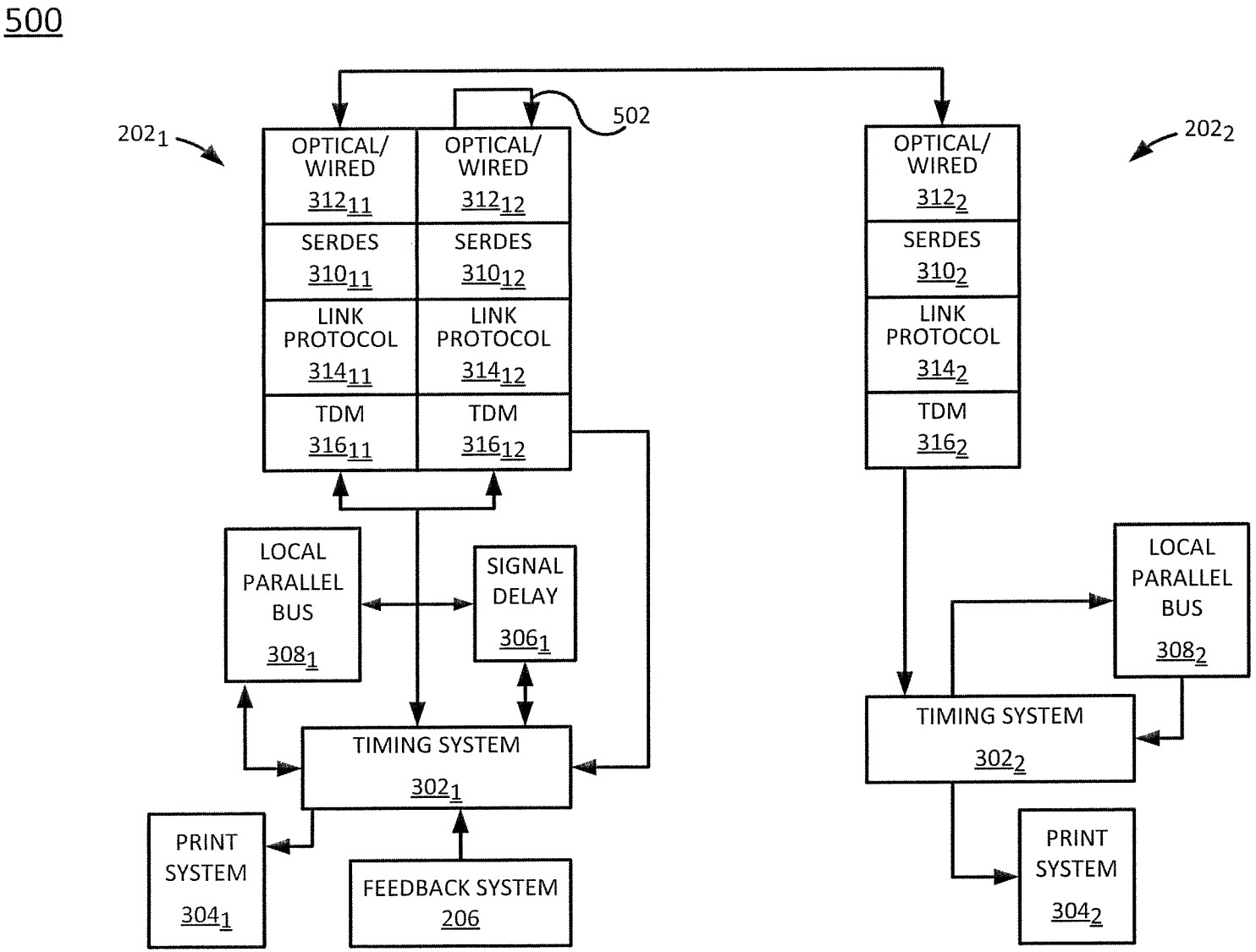
FIG. 5 is a block diagram of an example configuration of the fluid ejection devices of the present disclosure.

FIG. 5 illustrates a block diagram of an example configuration 500 of the fluid ejection devices 202 of the present disclosure. In one example, the fluid ejection device $\mathbf{202}_1$ may also include a link protocol module $\mathbf{314}_{11}$ and $\mathbf{314}_{12}$ and a time division multiplexing (TDM) module $\mathbf{316}_{11}$ and $\mathbf{316}_{12}$. The link protocol module $\mathbf{314}_{11}$ and $\mathbf{314}_{12}$ and the TDM module $\mathbf{316}_{11}$ and $\mathbf{316}_{12}$ may be added when more real-time sideband signals are generated or used than the hardware of a fluid ejection device can handle. For example, if a fluid ejection device $\mathbf{202}_1$ can handle 8 signals, but printing a particular image uses 16 signals, then the additional 8 signals may be time division multiplexed and the link protocol modules $\mathbf{314}_{11}$ and $\mathbf{314}_{12}$ may switch between the link protocols.

In one example, the configuration 500 may be deployed to determine an initial estimate for an amount of time delay. The configuration 500 may include a feedback channel or loopback physical channel 502 that includes an addition optical/wired connection $\mathbf{312}_{12}$, SERDES $\mathbf{310}_{12}$, link protocol module $\mathbf{314}_{12}$ and TDM $\mathbf{316}_{12}$. The loopback physical channel 502 may simulate a transmission of the real-time sideband signal to a respective fluid ejection device 202. For example, if a third fluid ejection device 202 were deployed, the loopback physical channel 502 may include a third stack.

The loopback physical channel 502 may provide an estimated time delay to the timing system $\mathbf{302}_1$ that can be used as the initial time delay to add to the real-time sideband signal for the fluid ejection device $\mathbf{202}_2$. The configuration 500 of FIG. 5 may use additional hardware in adding additional stacks of the loopback physical channel 502, but may provide faster processing.

Figure 6:
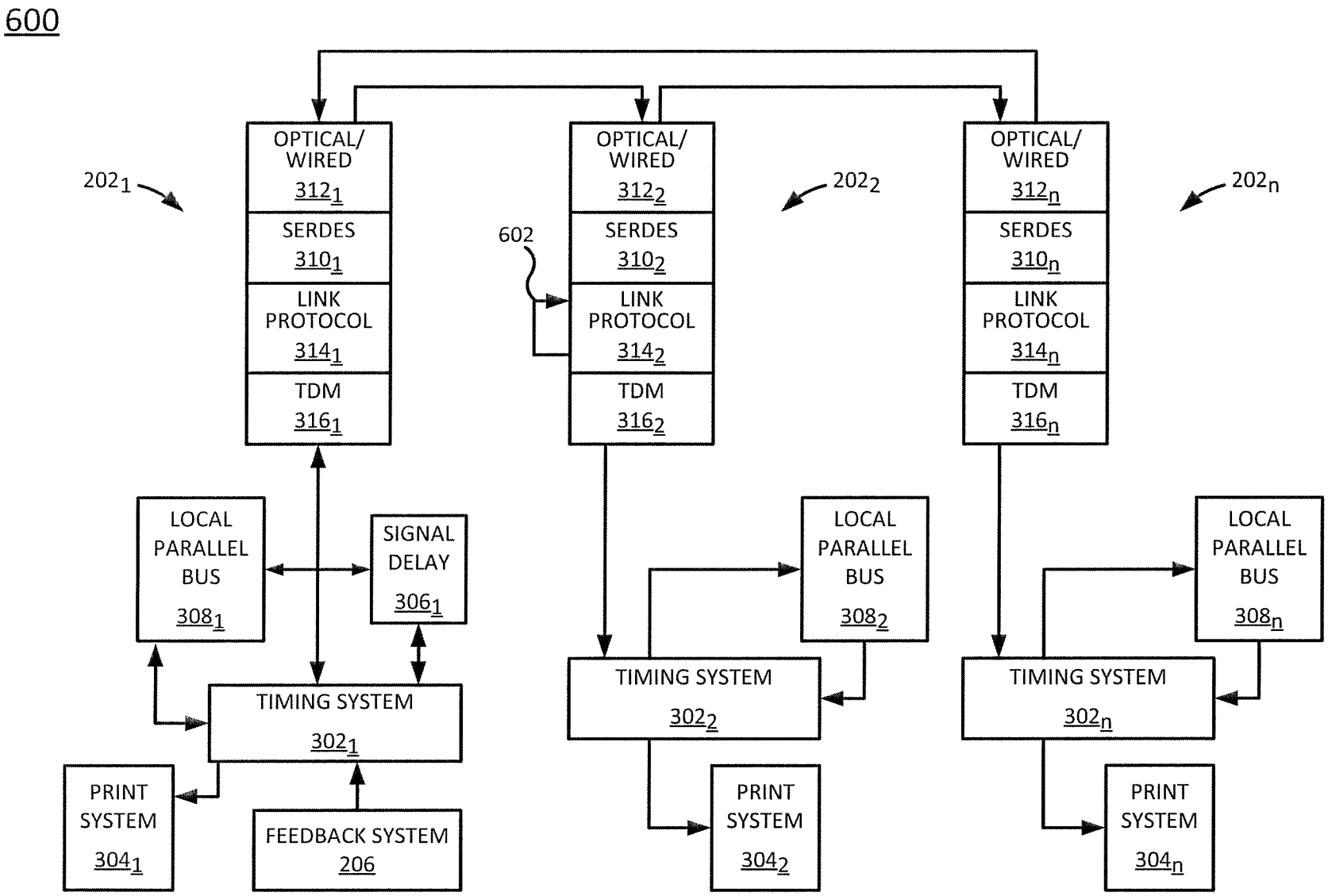
FIG. 6 is a block diagram of another example configuration of the fluid ejection devices of the present disclosure.

FIG. 6 illustrates a block diagram of an example configuration 600 of the fluid ejection devices 202 of the present disclosure. In one implementation, the fluid ejection devices 202 are connected such that the real-time sideband signal is forwarded to a last fluid ejection device $\mathbf{202}_n$. For example, the real-time sideband signal may be forwarded by the middle fluid ejection devices 202 (e.g., the fluid ejection device $\mathbf{202}_2$) via a feed forward timing signal 602 in the link protocol module $\mathbf{314}_2$. In another implementation, the feed forward timing signal 602 may be performed at the TDM $\mathbf{316}_2$ as well.

The amount of time delay associated with the last fluid ejection device $\mathbf{202}_n$ may be forwarded back to the first fluid ejection device $\mathbf{202}_1$. The amount of time delay seen by the last fluid ejection device $\mathbf{202}_n$ may be used as an initial amount of time delay for all of the fluid ejection devices $\mathbf{202}_1$ to $\mathbf{202}_n$.

In one example, after the initial amount of time delay is used, the amount of time delay may be adjusted based on an analysis by the sensor 204 and the calculations performed by the feedback system 206. In one example, the amount of time delay may be continuously calculated and inserted into the real-time sideband signals as each line is printed by the fluid ejection system 102 and the fluid ejection devices 202.

As a result, the examples of the present disclosure minimize the number of physical connections in the fluid ejection system 102. Reducing the number of physical connections can lead to higher system reliability. In addition, the reduction of the number of physical connections allows the design of the present disclosure to scale easily when a larger number of fluid ejection devices 202 are added for wider and wider media 106.

Figure 7:
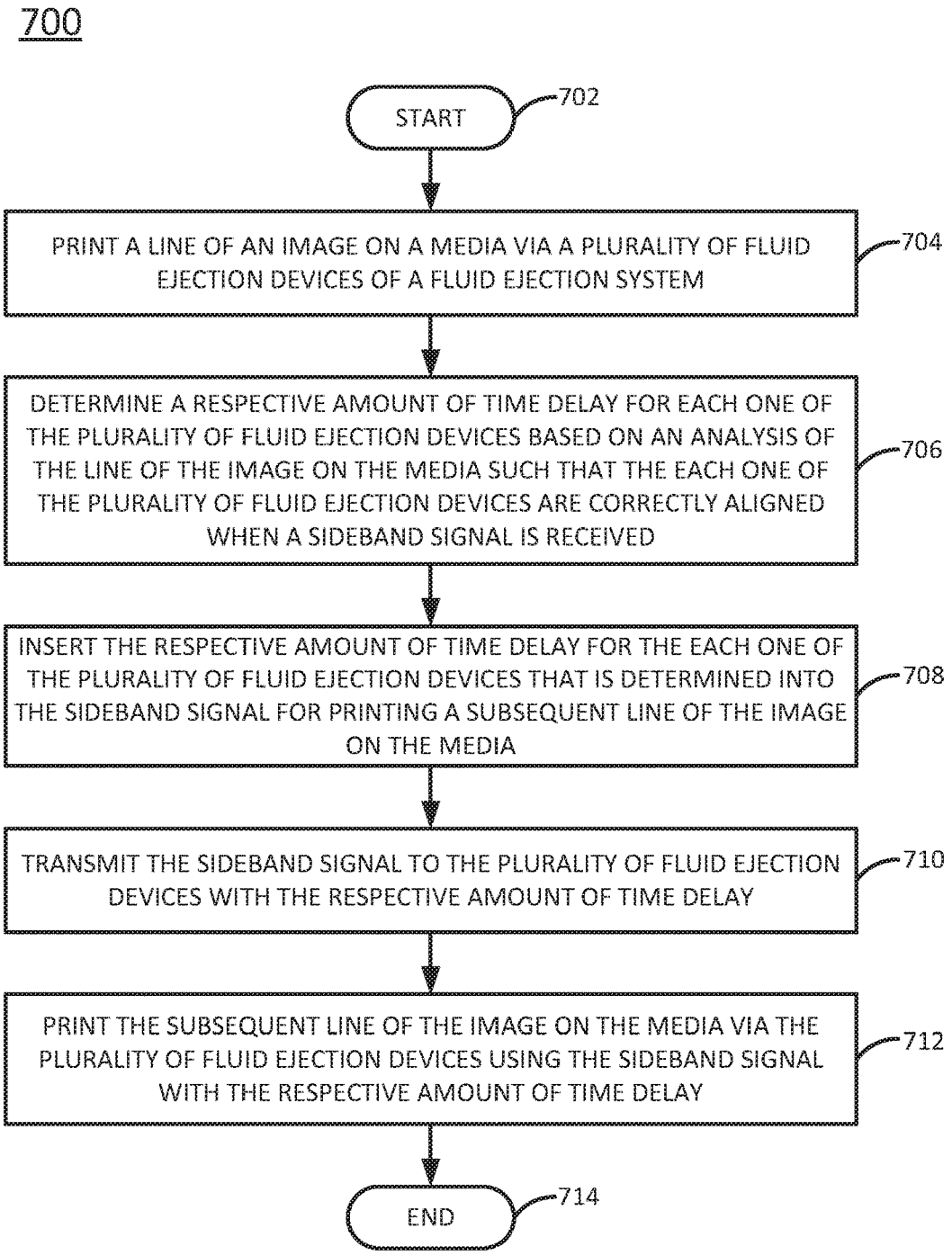
FIG. 7 is a flow diagram of an example method for distributing sideband signals in the fluid ejection system.

FIG. 7 illustrates a flow diagram of an example method 700 for distributing sideband signals in a fluid ejection system. In one example, the blocks of the method 700 may be performed by the system 100 or the fluid ejection system 102.

At block 702, the method 700 begins. At block 704, the method 700 prints a line of an image on a media via a plurality of fluid ejection devices of a fluid ejection system. For example, a plurality of real-time sideband signals may be generated to print each line of an image. The plurality of real-time sideband signals may be used to control each one of the plurality of fluid ejection devices to print each pixel of each line of the image across a width of a media.

At block 706, the method 700 determines a respective amount of time delay for each one of the plurality of fluid ejection devices based on an analysis of the line of the image on the media such that each one of the plurality of fluid ejection devices is correctly aligned when a sideband signal is received. In one example, an optical sensor may be used to determine an amount of offset between pixels printed by two different fluid ejection devices. The optical sensor may measure the amount of offset for each pair of fluid ejection devices. For example, if there are three fluid ejection devices deployed, the optical sensor may measure the amount of offset between the first and second fluid ejection devices and the amount of offset between the second and third fluid ejection devices.

The amount of offset may be used by a feedback system to calculate the respective amount of time delay for each one of the plurality of fluid ejection devices. For example, the feedback system may know a speed of the media moving below the fluid ejection devices or a speed of the fluid ejection devices moving over the media. Based on the speed and the amount of offset that is determined by the optical sensor, the feedback system may determine the respective amount of time delay of the sideband signal to reach each fluid ejection device.

At block 708, the method 700 inserts the respective amount of time delay for the each one of the plurality of fluid ejection devices that is determined into the sideband signal for printing a subsequent line of the image on the media. In one example, the feedback system may forward the respective amount of time delay for each fluid ejection device that is calculated to a first timing system. In one example, the first timing system may be associated with a first fluid ejection device (e.g., as illustrated in FIG. 3). The first timing system may then insert the respective amount of time delay into the sideband signals via a delay module and transmit the time delayed sideband signals to the remaining time systems associated with the remaining fluid ejection devices. The delay module may be a programmable delay module and/or a non-programmable delay module.

At block 710, the method 700 transmits the sideband signal to the plurality of fluid ejection devices with the respective amount of time delay. In one implementation, the sideband signal may include a plurality of sideband signals that are serialized and transmitted over a single optical wired connection. The remaining fluid ejection devices may have a respective SERDES that deserializes the sideband signals and uses the respective sideband signal with the respective amount of time delay. The remaining sideband signals may be serialized and forwarded to the next fluid ejection device, and so forth.

At block 712, the method 700 prints the subsequent line of the image on the media via the plurality of fluid ejection devices using the sideband signal with the respective amount of time delay. For example, the subsequent line of the image may be printed with a correct alignment of the fluid ejection devices using the sideband signal with the respective amount of time delay.

In one example, the method 700 may use an initial amount of time delay that is estimated. For example, the configuration 500 illustrated in FIG. 5 or the configuration 600 illustrated in FIG. 6 may be used to estimate the initial amount of time delay.

In one example, the method 700 may be repeated for each subsequent line of the image that is printed until printing of the image is completed on the media. For example, the method 700 may analyze the subsequent line that is printed, determine a respective time delay and print the next line with the respective amount of time delay inserted into the sideband signals, and so forth. At block 714, the method 700 ends.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A fluid ejection system, comprising:

a plurality of fluid ejection devices to distribute fluid onto a media;

a sensor to analyze a line of an image formed by the fluid on the media; and a feedback system to determine a time delay of a last fluid ejection device of the plurality of fluid ejection devices based on the line of the image on the media that is analyzed by the sensor and to insert the time delay into a sideband signal generated by a controller of the feedback system that is fed from a first fluid ejection device of the plurality of fluid ejection devices to each remaining fluid ejection device of the plurality of fluid ejection devices via serial connections to provide a correct alignment of the fluid ejection devices across a width of the media when printing a subsequent line of the image on the media.

2. The fluid ejection system of claim 1, comprising:

a first timing system associated with a first one of the plurality of fluid ejection devices that is in communication with the feedback system to receive a respective amount of time delay for each one of the plurality of fluid ejection devices that is determined.

3. The fluid ejection system of claim 2, comprising:

a plurality of timing systems associated with a remaining ones of the plurality of fluid ejection devices and in communication with the first timing system to receive the time delay from the first timing system.

4. The fluid ejection system of claim 3, wherein the first timing system is in communication with the plurality of timing systems associated with the remaining ones of the plurality of fluid ejection devices via a serial chain of optical connections.

5. The fluid ejection system of claim 4, comprising:

a serializer deserializer that serializes the at least one sideband signal into a coded serial stream that is transmitted over the serial chain of optical connections.

6. The fluid ejection system of claim 1, comprising:

a feedback channel to determine a transmission delay between the plurality of fluid ejection devices, wherein the transmission delay provides an initial time delay estimate to print the line of image on the media.

7. The fluid ejection system of claim 1, comprising:

a delay module to insert the time delay for the each one of the plurality of fluid ejection devices into the sideband signal.

8. The fluid ejection system of claim 7, wherein the delay module comprises a programmable delay module.

9. The fluid ejection system of claim 7, wherein the delay module comprises a non-programmable delay module.

10. The fluid ejection system of claim 1, wherein the sensor analyzes the line of the image on the media to determine an amount of offset between each portion of the line that is printed by a respective one of the plurality of fluid ejection devices, wherein the time delay is based on the amount of offset.

11. A system, comprising:

a print media;

a fluid ejection system to print a line of an image on the print media; and an inspection system to analyze the line of the image on the print media and determine a time delay for a last fluid ejection device of a plurality of fluid ejection devices within the fluid ejection system, wherein the time delay is inserted into a sideband signal generated by a controller of a feedback system that is fed from a first fluid ejection device of the plurality of fluid ejection devices to each remaining fluid ejection device of the plurality of fluid ejection devices via serial connections to provide a correct alignment of the plurality of fluid ejection devices across a width of the media when printing a subsequent line of the image on the print media.

12. The system of claim 11, comprises:

a sensor to perform the analysis of the line of the image; and a feedback system to calculate the time delay for the plurality of fluid ejection devices based on the analysis of the line of the image.

13. The system of claim 11, wherein at least one of the plurality of fluid ejection devices comprises:

a timing system in communication with the inspection system to receive the time delay for the plurality of the fluid ejection devices; and a delay module in communication with the timing system to insert the time delay for the plurality of fluid ejection devices.

14. A method, comprising:

printing a line of an image on a media via a plurality of fluid ejection devices of a fluid ejection system;

determining a time delay for a last fluid ejection device of the plurality of fluid ejection devices based on an analysis of the line of the image on the media such that the each one of the plurality of fluid ejection devices is correctly aligned across a width of the media when a sideband signal is received;

inserting the time delay into the sideband signal generated by a controller of a feedback system for printing a subsequent line of the image on the media;

transmitting the sideband signal from a first fluid ejection device of the plurality of fluid ejection devices to remaining fluid ejection devices of the plurality of fluid ejection devices with the time delay via serial connections; and printing the subsequent line of the image on the media via the plurality of fluid ejection devices using the sideband signal with the time delay.

15. The method of claim 14, wherein the determining, the inserting, the transmitting and the printing the subsequent line of the image on the media is repeated until printing of the image is completed.

* * * * *